US009280114B2

(12) United States Patent
Ogawa

(10) Patent No.: US 9,280,114 B2
(45) Date of Patent: Mar. 8, 2016

(54) IMAGE FORMING APPARATUS AND METHOD FOR CONTROLLING THE SAME

(71) Applicant: KYOCERA Document Solutions Inc., Osaka (JP)

(72) Inventor: Masanobu Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/724,335

(22) Filed: May 28, 2015

(65) Prior Publication Data

US 2015/0346665 A1 Dec. 3, 2015

(30) Foreign Application Priority Data

May 29, 2014 (JP) ..... 2014-111412

(51) Int. Cl.
*G03G 15/00* (2006.01)

(52) U.S. Cl.
CPC ..... *G03G 15/55* (2013.01); *G03G 15/80* (2013.01)

(58) Field of Classification Search
CPC ..... G03G 15/5004; G03G 15/80
See application file for complete search history.

(56) References Cited

U.S. PATENT DOCUMENTS 9,037,010 B2 * 5/2015 Naganawa ..... G03G 15/2039 399/37
9,075,088 B2 * 7/2015 Yang ..... G01R 19/0084
2014/0254210 A1 * 9/2014 Hayasaki ..... G03G 15/80 363/21.12

FOREIGN PATENT DOCUMENTS

JP 2001-212669 A 8/2001

* cited by examiner

*Primary Examiner* — Gregory H Curran
(74) *Attorney, Agent, or Firm* — Stein IP, LLC

(57) ABSTRACT

An image forming apparatus includes a zero cross signal generator, a lower limit detector for detecting whether or not an absolute value of a peak voltage of an AC voltage is a lower limit value or lower, a determining unit to control a first up/down counter to increment by one when the absolute value of the peak voltage of the AC voltage is the lower limit value or lower in a half period and to decrement by one when the absolute value has not become the lower limit value or lower, and to determine that a to-be-recorded deviation for which information is recorded has occurred when a value of the first up/down counter becomes a predetermined lower limit reference value or higher, and a storage unit for storing deviation information indicating the deviation in a nonvolatile manner when the to-be-recorded deviation has occurred.

10 Claims, 10 Drawing Sheets

IMAGE FORMING APPARATUS AND METHOD FOR CONTROLLING THE SAME

INCORPORATION BY REFERENCE

This application is based upon and claims the benefit of priority from the corresponding Japanese Patent Application No. 2014-111412 filed May 29, 2014, the entire contents of which are hereby incorporated by reference.

BACKGROUND

The present disclosure relates to an image forming apparatus configured to detect a deviation of AC voltage supplied from a commercial power supply.

The image forming apparatus is supplied with power from a commercial power supply (AC power supply) via an outlet and a power cable. The commercial power supply is connected to a power supply device of the image forming apparatus. The power supply device includes a rectifying circuit and a power conversion circuit (a switching power supply circuit, a converter, or the like) for generating voltages suitable for circuits or elements included in the image forming apparatus. Here, the voltage of the commercial power supply may be deviated from the nominal voltage. When the deviation is large, the power supply device inside the image forming apparatus may be broken down.

There is known an example of technique as below, in which an abnormality of voltage of the commercial power supply (AC power supply) is detected so as to protect a circuit or an element included in the power supply device. Specifically, there is a power supply device, which converts a power input from the power supply into a first power to be output, detects a voltage of the power from the power supply, generates a power supply voltage detection signal indicating a detection voltage value, determines whether or not the detection voltage value is within a first permissible range, outputs a first control signal when determining that the detection voltage value is not within the first permissible range, outputs predetermined information when the first control signal is output, determines whether or not the detection voltage value is within a second permissible range that includes the first permissible range and is wider than the first permissible range, outputs a second control signal when determining that the detection voltage value is not within the second permissible range, and stops operations of a part of elements constituting the power supply device, a part estimated to be damaged when the voltage of power from the power supply is deviated, or the entire thereof when the second control signal is output. When an abnormality of the commercial power supply occurs, the power supply device included in the apparatus is protected.

Quality of the commercial power supply (electric power circumstance) depends on a country or a region. There are countries or regions where an amplitude and a frequency of the commercial power supply are always stable to have a regular waveform, while there are countries or regions having a large deviation of amplitude (deviation from nominal voltage or a voltage deviation) and a large deviation of a frequency. In a country or a region where the infrastructure related to electric power is not sufficiently developed, the voltage of the commercial power supply is apt to deviate from the nominal voltage. In addition, there is a tendency that the in-house wiring has many mistakes in the region where the voltage of the commercial power supply is apt to deviate. A mistake in wiring may cause the situation where an AC voltage deviated largely from the nominal voltage is supplied to the image forming apparatus.

When an absolute value of a peak value of the voltage from the commercial power supply exceeds a value and a period of design that the power supply device of the image forming apparatus can endure, an element or a circuit (e.g., a switching element) included in the power supply device is broken down. For this reason, it is necessary to design the power supply device of the image forming apparatus to endure as much as possible even if a deviation of the commercial power supply from the nominal voltage becomes large so that the absolute value of the peak value of the AC voltage becomes large in a country or a region where the image forming apparatus is sold and used.

On the other hand, when the absolute value of the peak value of the voltage from the commercial power supply is decreased or the decreased state is continued, the image forming apparatus may stop its operation because of a decrease of voltage supplied to the circuit. For this reason, it is preferred to design the power supply device of the image forming apparatus so that the image forming apparatus continues to operate even if the AC absolute value of the peak value of the voltage from the commercial power supply continues for a certain period in a country or a region where the image forming apparatus is sold and used.

However, there is a problem that it is difficult to know a situation of the voltage deviation from the nominal voltage in a country or a region where the image forming apparatus is sold and used. When the deviation of the AC voltage of the commercial power supply from the nominal voltage, a period from start to end of the exceeding the permissible range, occurrence frequency of the deviation, and the like in the country or the region are not known, it is difficult to design and develop the power supply device suitable for the country or the region. In other words, it is not possible to define a specific specification (e.g., a withstand voltage) of the power supply device in which the power supply device is not broken down so that the image forming apparatus can continue to operate when a voltage deviation of the commercial power supply from the nominal voltage occurs. In addition, it is also difficult to determine whether or not the current power supply device of the image forming apparatus has a problem or should be improved.

Here, the known power supply device described above detects abnormality of the power supply voltage so as to protect the power supply device and issues warning before the protecting function works. However, information indicating a situation of the commercial power supply in a country or a region where the apparatus is used is not saved. Accordingly, it is not possible to know a situation of a voltage deviation of the commercial power supply in a country or a region where the image forming apparatus is sold and used.

SUMMARY

In order to solve the above-mentioned problem, an image forming apparatus according to one aspect of the present disclosure includes a zero cross signal generator, a lower limit detector, a determining unit, and a storage unit. The zero cross signal generator generates a zero cross signal on the basis of an AC voltage input to the image forming apparatus. The lower limit detector detects whether or not an absolute value of a peak voltage of the AC voltage input to the image forming apparatus is a predetermined lower limit value or lower. The determining unit includes a first up/down counter, checks whether or not the absolute value of the peak voltage is the lower limit value or lower on the basis of the zero cross signal and an output of the lower limit detector every half period of the AC voltage, controls the first up/down counter to increment by one when the absolute value is the lower limit value or lower, controls the first up/down counter to decrement by one when the absolute value is larger than the lower limit value, and determines that a to-be-recorded deviation that is a deviation of the AC voltage to be recorded has occurred when a value of the first up/down counter becomes a predetermined lower limit reference value or higher. The storage unit stores deviation information indicating a voltage deviation of the to-be-recorded deviation in a nonvolatile manner when the determining unit determines that the to-be-recorded deviation has occurred.

Further features and advantages of the present invention will become apparent from the description of embodiments given below.

DETAILED DESCRIPTION

The present disclosure is aimed to contribute to developing and designing a power supply device suitable for a country or a region where the image forming apparatus is sold and used by accumulating information indicating a situation of voltage deviation from nominal voltage of a commercial power supply. Hereinafter, an embodiment of the present disclosure is described with reference to FIGS. 1 to 12. In this description, an electrophotographic multifunction peripheral 100 is exemplified as the image forming apparatus. However, the elements such as structures and layouts described in each embodiment should not be interpreted to limit the scope of the disclosure and are merely examples for description.

(Structures of Multifunction Peripheral 100)

Figure 1:
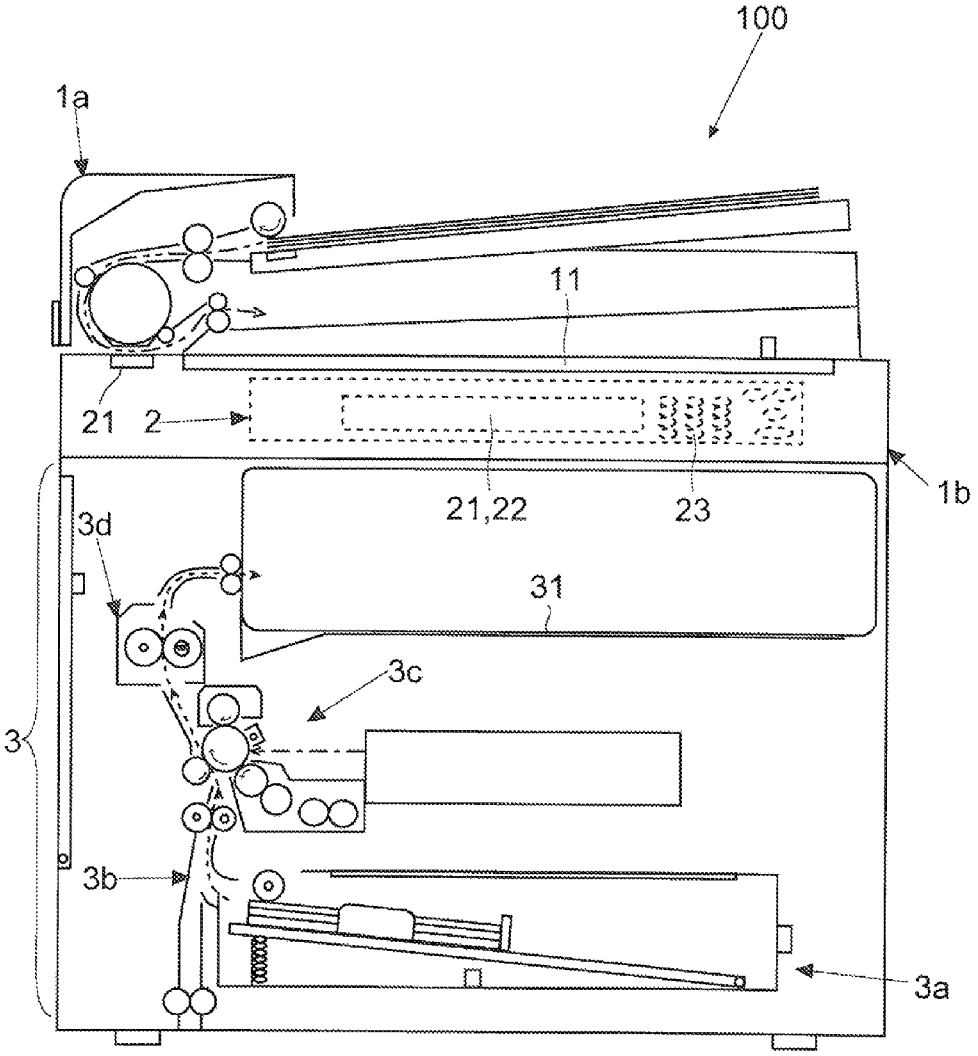
FIG. 1 shows an example of a multifunction peripheral.
Figure 2:
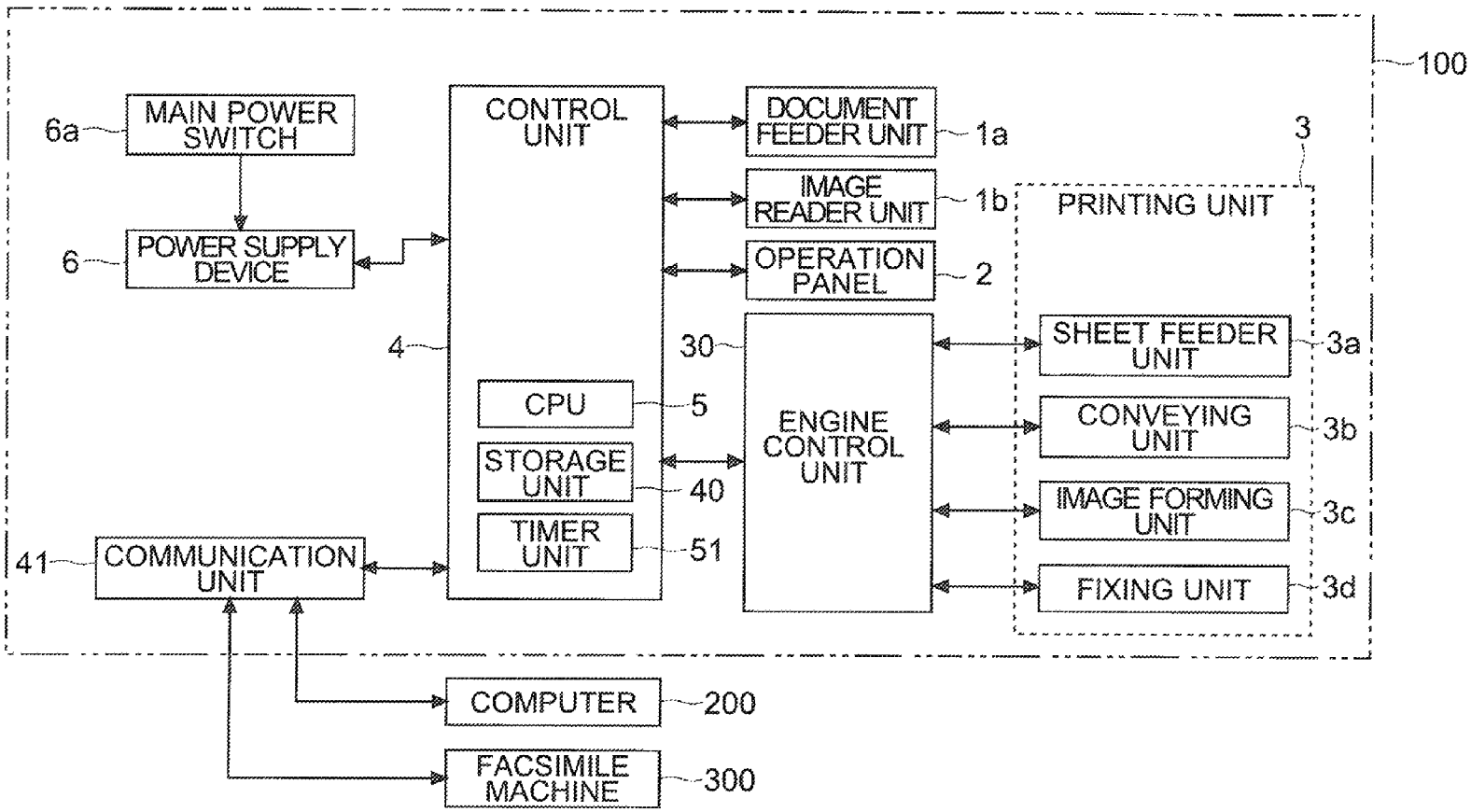
FIG. 2 shows an example of a hardware structure of the multifunction peripheral.

First, with reference to FIGS. 1 and 2, an outline of the image forming apparatus according to the embodiment is described. FIGS. 1 and 2 show an example of the multifunction peripheral 100.

The multifunction peripheral 100 of this embodiment includes, in an upper part thereof, a document feeder unit 1*a*, an image reader unit 1*b*, and an operation panel 2 (corresponding to an operation unit). In addition, a sheet feeder unit 3*a*, a conveying unit 3*b*, an image forming unit 3*c*, a fixing unit 3*d*, and the like are disposed as a printing unit 3 in a main body of the multifunction peripheral 100.

The operation panel 2 includes a display unit 21 for displaying setting screens and keys, a touch panel unit 22 for accepting an operation to a key displayed on the display unit 21, and various hardware keys 23. The image reader unit 1*b* reads document sheets fed consecutively by the document feeder unit 1*a* or a document placed on a place reading contact glass 11 so as to generate image data.

The sheet feeder unit 3*a* stores sheets of paper for printing and sends out the sheet of paper to the conveying unit 3*b*. The conveying unit 3*b* conveys the sheet of paper in the apparatus. In addition, the apparatus is also provided with a discharge tray 31 for receiving the sheet of paper discharged from an outlet. The image forming unit 3*c* forms a toner image on the basis of image data and transfers the toner image onto the sheet of paper being conveyed. The fixing unit 3*d* fixes the toner image transferred onto the sheet of paper. The sheet of paper after fixing the toner image is discharged to the discharge tray 31.

As shown in FIG. 2, first, a control unit 4 for controlling operations of the multifunction peripheral 100 is disposed in the main body of the multifunction peripheral 100. The control unit 4 includes a CPU 5 (corresponding to a determining unit 9). The control unit 4 integrally controls the entire operation of the multifunction peripheral 100. The control unit 4 includes a block for performing general control, a block for performing communication control, and a block for performing image processing.

A storage unit 40 can store a program and data for controlling the multifunction peripheral 100, and other data such as image data. The storage unit 40 includes a nonvolatile memory such as a ROM, an HDD, a flash ROM, and a volatile memory such as a RAM. The CPU 5 controls the multifunction peripheral 100 on the basis of the program and data stored in the storage unit 40. In addition, the storage unit 40 stores deviation information i1 indicating a voltage deviation, in a nonvolatile manner (see FIGS. 4 and 9).

In addition, the apparatus includes an engine control unit 30 for controlling the printing unit 3 on the basis of a command from the control unit 4. In addition, the control unit 4 controls the document feeder unit 1*a* and the image reader unit 1*b* to read a document and generate image data. In addition, the control unit 4 is connected to the operation panel 2 so as to communicate therewith. In this way, content of setting performed with the operation panel 2 is transmitted to the control unit 4. The control unit 4 issues an instruction to each unit of the multifunction peripheral 100 in accordance with the set content so that the each unit operates.

The control unit 4 is connected to a communication unit 41. The communication unit 41 communicates with a computer 200 (e.g., a personal computer or a server) or a facsimile machine 300 on the other end via a network, a cable, or a communication network, so as to realize a printer function, a transmission function, or a facsimile function. In addition, a power supply device 6 is disposed in the multifunction peripheral 100. The power supply device 6 generates a plurality of voltages necessary for operating the units in the multifunction peripheral 100 and supplies the voltages to the units (details thereof will be described later).

(Power Supply System)

Figure 3:
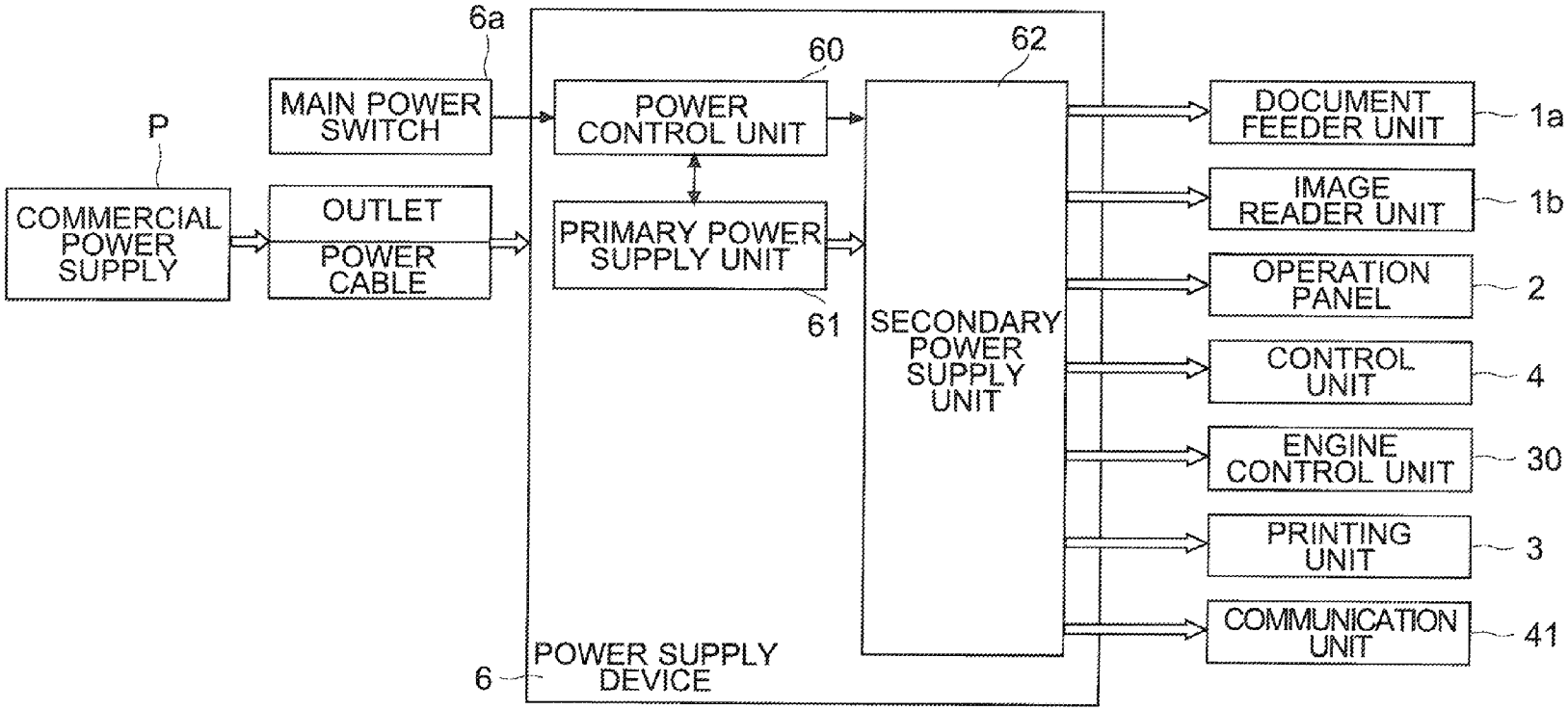
FIG. 3 shows an example of a power supply system of the multifunction peripheral.

Next, an example of the power supply system of the multifunction peripheral 100 according to the embodiment is described on the basis of FIG. 3.

The power supply device 6 is connected to a commercial power supply P via an outlet and a power cable. A nominal voltage (root mean square value) of the commercial power supply P supplied to a power consumer is different depending on country. The nominal voltage is AC 100/200 V in Japan, 120/240 V in USA, and 220 V in China. In addition, the multifunction peripheral 100 is provided with a main power switch 6*a* for turning on and off a main power. In addition, the power supply device 6 includes a primary power supply unit 61. The primary power supply unit 61 is a switching power supply including a coil, a capacitor, a semiconductor switch, and a diode. The primary power supply unit 61 converts the voltage supplied from the commercial power supply P into a DC voltage having a constant value (e.g., DC 24 V for driving motors).

In addition, the power supply device 6 includes a secondary power supply unit 62. The secondary power supply unit 62 converts the voltage generated by the primary power supply unit 61 into DC voltages for driving a circuit in the control unit 4 such as the CPU 5, and circuits, elements, and memories in the storage unit 40, the operation panel 2, the printing unit 3, the engine control unit 30, the document feeder unit 1*a*, the image reader unit 1*b*, and the communication unit 41. The secondary power supply unit 62 includes a plurality of DC-DC converters and regulators. The secondary power supply unit 62 generates a plurality of voltages such as DC 5 V, 3.3 V, 2.5 V, 1.8 V, and 1.2 V. A power control unit 60 recognizes on and off of the main power by operation with the main power switch 6*a*. The power control unit 60 controls the secondary power supply unit 62 to operate in a state where the main power is on and controls the secondary power supply unit 62 to stop in a state where the main power is off (the primary power supply unit 61 may also be turned on or off in synchronization with turning on or off of the main power).

(Detection of Voltage Deviation)

Figure 4:
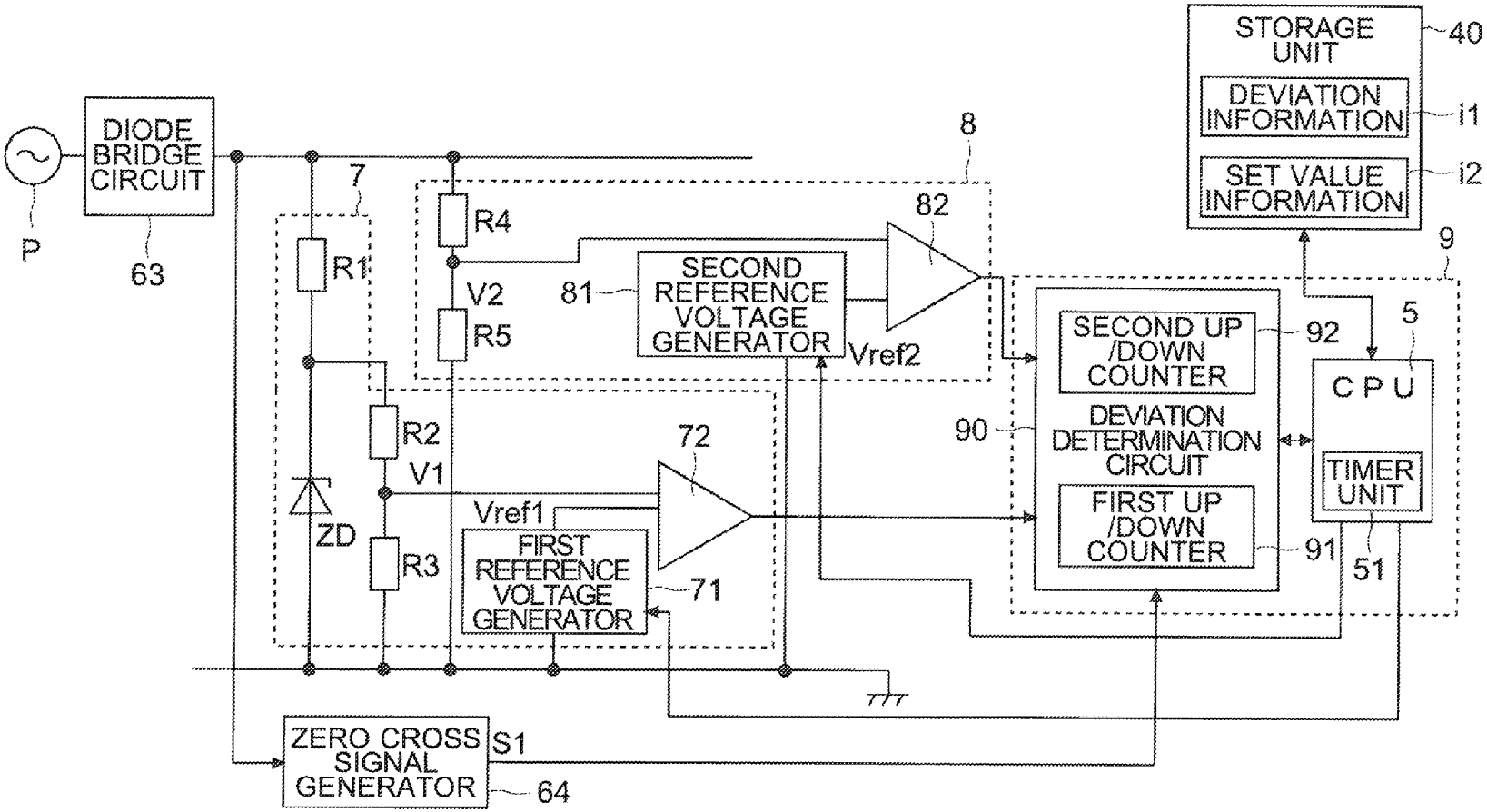
FIG. 4 shows an example of a part for detecting a voltage deviation to be recorded.

Next, with reference to FIG. 4, a part for detecting a voltage deviation to be recorded (to-be-recorded deviation) is described.

As shown in FIG. 4, the image forming apparatus according to the embodiment includes a diode bridge circuit 63 (corresponding to a rectifying circuit), a zero cross signal generator 64, a lower limit detector 7, an upper limit detector 8, the determining unit 9, the storage unit 40, and the like.

First, the diode bridge circuit 63 is connected to the commercial power supply P (the outlet) via the power cable and the like. Further, the diode bridge circuit 63 includes four diodes so as to perform full-wave rectification of the AC power (sine wave alternating current) supplied from the commercial power supply P into DC power. Note that a smoothing circuit is not disposed.

The zero cross signal generator 64 generates a zero cross signal S1 on the basis of an output voltage of the diode bridge circuit 63. The zero cross signal generator 64 outputs high level in a period while the output voltage value of the diode bridge circuit 63 is within a certain range including 0 V, and outputs low level in other period. Note that the zero cross signal S1 may have the opposite logic.

The lower limit detector 7 is a circuit for detecting whether or not an absolute value of a peak voltage of the AC voltage of the commercial power supply P input to the multifunction peripheral 100 is a predetermined lower limit value or lower. The lower limit value can be appropriately determined. For instance, the lower limit value is determined within a range of −15 to −30% of the peak value (absolute value of the maximum instantaneous value) of the nominal voltage of the commercial power supply P.

The lower limit detector 7 includes a resistor R1, a resistor R2, a resistor R3, a first reference voltage generator 71, and a first comparator 72. The resistor R1 is connected to an output of the diode bridge circuit 63. In addition, with respect to the resistor R1, a series circuit of the resistor R2 and the resistor R3 is connected to a Zener diode ZD in parallel. Then, a voltage V1 at the node between the resistor R2 and the resistor R3 is applied to one of input terminals of the first comparator 72. In addition, an output of the first reference voltage generator 71 is input to the other terminal of the first comparator 72. The first reference voltage generator 71 generates and outputs a voltage (first reference voltage Vref1) having a value designated by the CPU 5 (control unit 4). For instance, the first reference voltage generator 71 is a digital-to-analog converter.

A ratio of the voltage V1 at the node between the resistor R2 and the resistor R3 to the absolute value of the AC voltage (output value of the diode bridge circuit 63) is determined. Accordingly, the CPU 5 issues an instruction to the first reference voltage generator 71 to generate a voltage having a value obtained by dividing the lower limit value by the ratio as the first reference voltage Vref1. Further, when the voltage V1 is the first reference voltage Vref1 or lower, the first comparator 72 outputs high level (indicating that the absolute value of the AC voltage is lower limit value or lower). In addition, when the voltage V1 is higher than the first reference voltage Vref1, the first comparator 72 outputs low level (indicating that the absolute value of the AC voltage is higher than the lower limit value). In this way, the lower limit detector 7 detects whether or not the absolute value of the peak voltage of the AC voltage input to the multifunction peripheral 100 is the lower limit value or lower on the basis of the DC voltage obtained by rectification by the rectifying circuit (diode bridge circuit 63) and outputs a signal according to the detection result.

On the other hand, the upper limit detector 8 is a circuit for detecting whether or not the absolute value of the AC voltage (commercial power supply voltage) input to the multifunction peripheral 100 is a predetermined upper limit value or higher. The upper limit value can be appropriately determined (details thereof will be described later). For instance, the upper limit value is determined within a range of +15 to +30% of the peak value (absolute value of the maximum instantaneous value) of the nominal voltage of the commercial power supply P.

Specifically, the upper limit detector 8 includes a resistor R4, a resistor R5, a second reference voltage generator 81, and a second comparator 82. A series circuit of the resistor R4 and the resistor R5 is connected to the output of the diode bridge circuit 63. Further, a voltage V2 at the node between the resistor R4 and the resistor R5 is input to one of terminals of the second comparator 82. In addition, an output of the second reference voltage generator 81 is input to the other terminal of the second comparator 82. The second reference voltage generator 81 generates and outputs a voltage (second reference voltage Vref2) having a value designated by the CPU 5 (control unit 4). For instance, the second reference voltage generator 81 is a digital-to-analog converter.

A ratio of the voltage V2 at the node between the resistor R4 and the resistor R5 to the value of the AC voltage (output value of the diode bridge circuit 63) is determined. Accordingly, the CPU 5 issues an instruction to the second reference voltage generator 81 to generate a voltage having a value obtained by dividing a predetermined upper limit value by the ratio as the second reference voltage Vref2. Further, when the voltage V2 is the second reference voltage Vref2 or higher, the second comparator 82 outputs low level (indicating that the absolute value of the AC voltage is the upper limit value or higher). In addition, when the voltage V2 is lower than the second reference voltage Vref2, the second comparator 82 outputs high level (indicating that the absolute value of the AC voltage is lower than the upper limit value). In this way, the upper limit detector 8 detects whether or not the absolute value of the peak voltage of the AC voltage input to the multifunction peripheral 100 is the upper limit value or higher on the basis of the DC voltage obtained by rectification by the rectifying circuit (diode bridge circuit 63) and outputs a signal according to the detection result.

Further, the determining unit 9 includes a deviation determination circuit 90 and the CPU 5. The deviation determination circuit 90 includes a first up/down counter 91 and a second up/down counter 92. The deviation determination circuit 90 checks whether or not the absolute value of the peak voltage is the lower limit value or lower every half period of the commercial power supply P (AC voltage) on the basis of the zero cross signal S1 and an output of the lower limit detector 7.

Further, the first up/down counter 91 increments by one when the absolute value of the peak voltage of the AC voltage in half period is the lower limit value or lower, and decrements by one when the absolute value of the peak voltage of the AC voltage in half period has not become the lower limit value or lower. When the count value of the first up/down counter 91 is changed, the CPU 5 recognizes the count value after the change. Further, when the value of the first up/down counter 91 becomes a predetermined lower limit reference value or higher, the CPU 5 determines that a to-be-recorded deviation, which is an AC voltage deviation for which information is recorded, has occurred.

On the other hand, as to the upper limit, the deviation determination circuit 90 checks whether or not the absolute value of the peak voltage is the upper limit value or higher every half period of the commercial power supply P (AC voltage) on the basis of the zero cross signal S1 and an output of the upper limit detector 8.

Further, the second up/down counter 92 increments by one when the absolute value of the peak voltage of the AC voltage in half period becomes the upper limit value or higher, and decrements by one when the absolute value of the peak voltage of the AC voltage in half period has not become the upper limit value or higher. When the count value of the second up/down counter 92 is changed, the CPU 5 recognizes the count value. Further, when a value of the second up/down counter 92 becomes a predetermined upper limit reference value or higher, the CPU 5 determines that the to-be-recorded deviation has occurred. When the determining unit 9 determines that the to-be-recorded deviation has occurred, the storage unit 40 stores deviation information i1 indicating a voltage deviation from the nominal voltage in the to-be-recorded deviation, in a nonvolatile manner (details thereof will be described later).

(Output of Lower Limit Detector 7)

Figure 5:
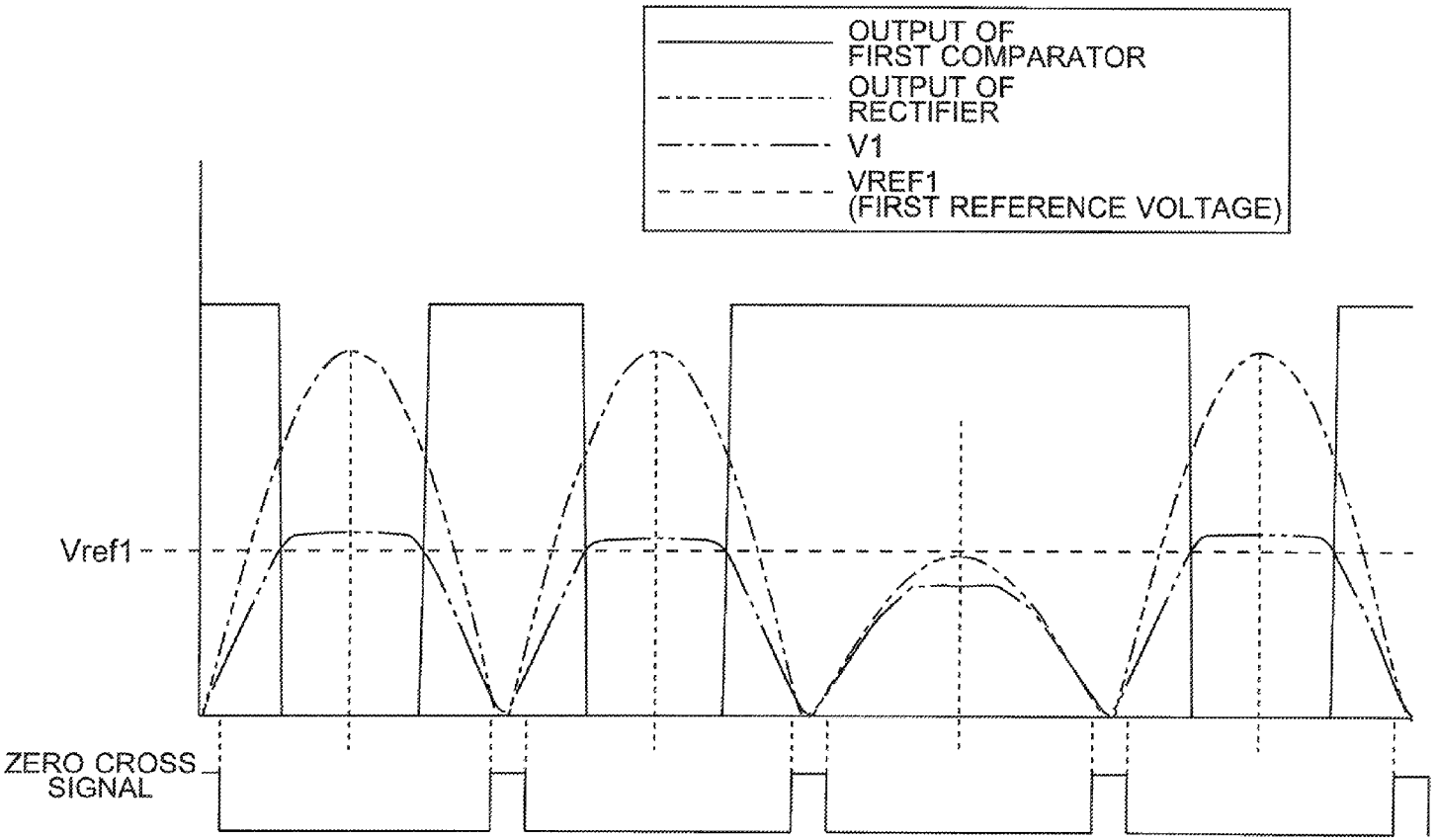
FIG. 5 shows an example of output waveforms of a lower limit detector.

Next, with reference to FIGS. 4 and 5, output waveforms of the lower limit detector 7 are described.

In FIG. 5, a dot-dashed line indicates a rectified waveform of the AC voltage of the commercial power supply P by the diode bridge circuit 63 (full-wave rectified waveform of the AC voltage of the commercial power supply P). In addition, FIG. 5 shows the zero cross signal S1 generated by the zero cross signal generator 64. In the example of FIG. 5, when the output value of the diode bridge circuit 63 (absolute value of the AC voltage of the commercial power supply P) is a voltage value within a certain range close to zero (ground level), the zero cross signal S1 becomes high level. In the outside of the certain range, the zero cross signal S1 becomes low level. Accordingly, the zero cross signal S1 is a signal rising one time every half period of the AC voltage of the commercial power supply P.

Further, a broken line in FIG. 5 indicates the first reference voltage Vref1 corresponding to the lower limit value. In addition, an example of the voltage V1 (at the node between the resistor R2 and the resistor R3 as shown in FIG. 4), which is input to the first comparator 72 and is compared with the first reference voltage Vref1, is shown by a double-dot-dashed line. In the period while the absolute value of the AC voltage of the commercial power supply P is the lower limit value or lower (the period while the voltage V1 is the first reference voltage Vref1 or lower), the first comparator 72 outputs high level. For this reason, the output of the first comparator 72 once falls and then rises during the half period of the commercial power supply P when the AC absolute value of the peak value of the voltage of the commercial power supply P has not become the lower limit value or lower (when the AC absolute value of the peak value of the voltage of the commercial power supply P is higher than the lower limit value and is normal).

On the other hand, when the peak voltage of the commercial power supply P deviates to decrease from the nominal voltage so that the state where the absolute value of the AC voltage is the lower limit value or lower continues for the half period of the commercial power supply P, the output of the first comparator 72 keeps high level. For this reason, when the absolute value of the AC voltage of the commercial power supply P continues to be the lower limit value or lower during the half period, the output of the first comparator 72 does not change during the half period of the commercial power supply P. Specifically, in FIG. 5, among the output waveforms of the diode bridge circuit 63, the third wave from left indicates an example where the AC absolute value of the peak value of the voltage is the lower limit value or lower. Further, during the third wave from left, the output of the first comparator 72 keeps high level.

Here, in FIG. 5, a time point when the absolute value of the AC voltage of the commercial power supply P becomes a peak (a midpoint of the period of the zero cross signal S1) is shown by a vertical broken line. Because frequency of the commercial power supply P is determined, a time zone (time point) when the AC voltage of the commercial power supply P becomes the peak value after the zero cross signal S1 rises can be estimated. For instance, it can be estimated that the AC voltage of the commercial power supply P becomes the peak value at a time point when an approximately ¼ period of the AC voltage of the commercial power supply elapses after the zero cross signal S1 rises.

Accordingly, the first up/down counter 91 of the deviation determination circuit 90 uses the zero cross signal S1 as a trigger so as to check the output of the first comparator 72 a plurality of times in a predetermined first measurement time zone after a predetermined time elapses from rising of the zero cross signal S1 (time zone estimated to include the time point of the peak value). Further, when the high level continues during the first measurement time zone, the first up/down counter 91 detects and determines that the absolute value of the peak voltage of the AC voltage is the lower limit value or lower in the half period. Further, the first up/down counter 91 increments the count value by one. On the contrary, when the low level appears at least one time during the first measurement time zone, the first up/down counter 91 detects and determines that the absolute value of the peak voltage of the AC voltage has exceeded the lower limit value in the half period. Then, the first up/down counter 91 decrements the count value by one.

In addition, the first up/down counter 91 of the deviation determination circuit 90 may use the zero cross signal S1 as a trigger so as to check the output of the first comparator 72 one time at a first estimated time point when a predetermined time elapses after the zero cross signal S1 rises (time point estimated as the time point of the peak value in the half period of the AC voltage). Further, when the output of the first comparator 72 at the estimated time point is high level, the first up/down counter 91 may detect and determine that the absolute value of the peak voltage of the AC voltage is the lower limit value or lower in the half period so as to increment the count value by one. On the contrary, when the output of the first comparator 72 at the first estimated time point is low level, the first up/down counter 91 may detect and determine that the absolute value of the peak voltage of the AC voltage has exceeded the lower limit value in the half period so as to decrement the count value by one.

Alternatively, the first up/down counter 91 may check the output of the first comparator 72 a plurality of times in a periodical and consecutive manner during a period from rising of the zero cross signal S1 to the next rising. Further, when the output of the first comparator 72 does not ever become low level in the period from rising of the zero cross signal S1 to the next rising, the first up/down counter 91 detects and determines that the absolute value of the peak voltage of the AC voltage is the lower limit value or lower in the half period so as to increment the count value by one. On the contrary, when the output of the first comparator 72 becomes the low level at least one time during the period from rising of the zero cross signal S1 to the next rising, the first up/down counter 91 detects and determines that the absolute value of the peak voltage of the AC voltage has exceeded the lower limit value in the half period so as to decrement the count value by one.

(Output of the Upper Limit Detector 8)

Figure 6:
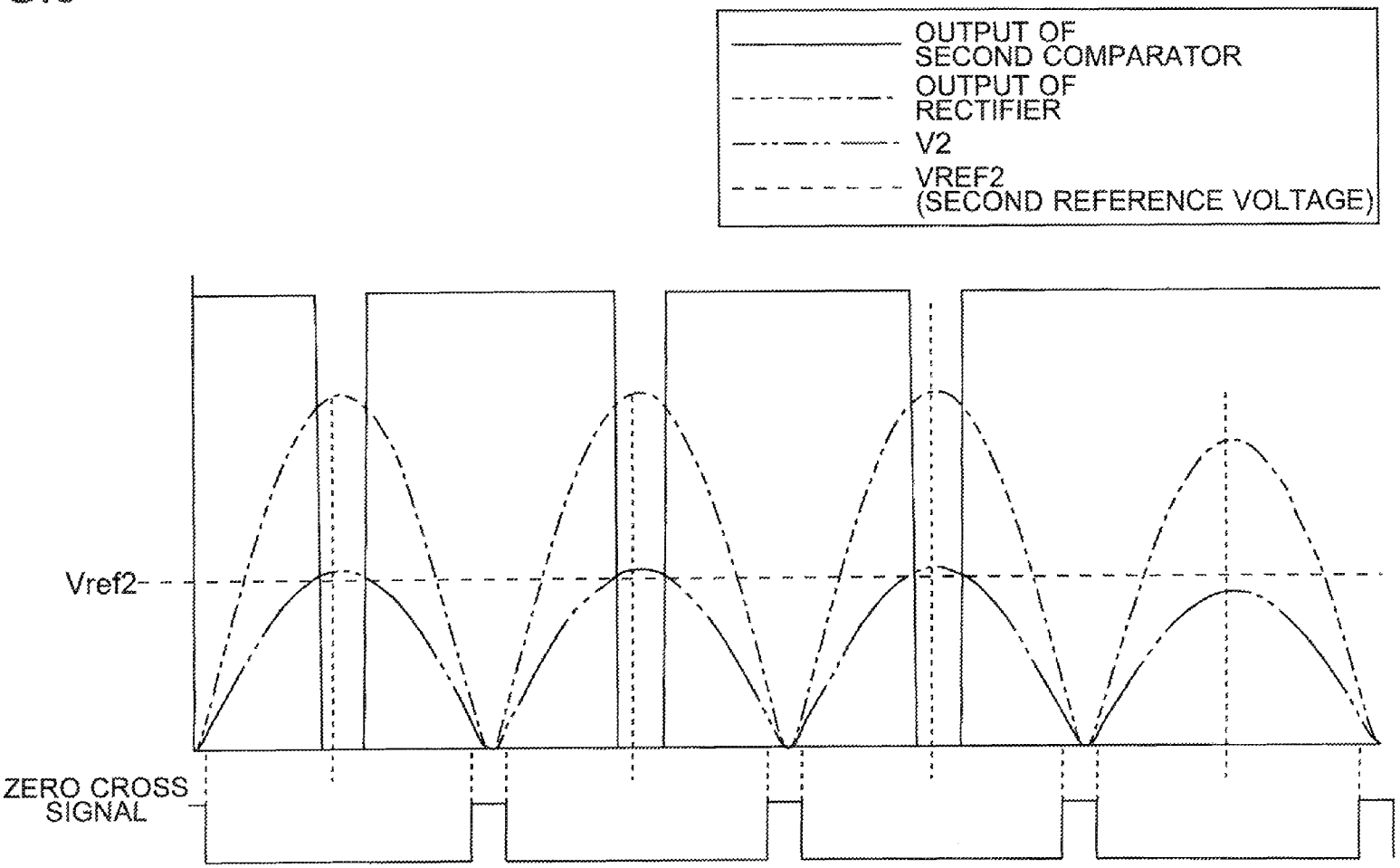
FIG. 6 shows an example of output waveforms of an upper limit detector.

Next, with reference to FIGS. 4 and 6, output waveforms of the upper limit detector 8 are described.

Also in FIG. 6, a dot-dashed line indicates a rectified waveform of the AC voltage of the commercial power supply P by the diode bridge circuit 63 (full-wave rectified waveform of the AC voltage of the commercial power supply P). In addition, FIG. 6 also shows the zero cross signal S1 generated by the zero cross signal generator 64. Further, in FIG. 6, the second reference voltage Vref2 corresponding to the upper limit value is shown by a broken line. In addition, the voltage V2 (at the node between the resistor R4 and the resistor R5 as shown in FIG. 4), which is input to the second comparator 82 and is compared with the second reference voltage Vref2, is shown by a double-dot-dashed line.

In the period while the absolute value of the AC voltage of the commercial power supply P is the upper limit value or higher (the period while the voltage V2 is the second reference voltage Vref2 or higher), the second comparator 82 outputs low level. For this reason, the output of the second comparator 82 keeps the high level during the half period of the commercial power supply P when the absolute value of the peak value of the AC voltage of the commercial power supply P does not ever become upper limit value or higher. On the other hand, when the peak voltage of the commercial power supply P deviates to increase from the nominal voltage so that the absolute value of the AC voltage is the upper limit value or higher during the half period, the output of the second comparator 82 repeatedly switches between the high level and the low level during the half period.

Here, in FIG. 6, a time point when the absolute value of the AC voltage of the commercial power supply P becomes a peak (a midpoint of the period of the zero cross signal S1) is shown by a broken line. Because frequency of the commercial power supply P is determined, a time zone (time point) when the AC voltage of the commercial power supply P becomes the peak value after the zero cross signal S1 rises can be estimated.

Accordingly, the second up/down counter 92 of the deviation determination circuit 90 uses the zero cross signal S1 as a trigger so as to check the output of the second comparator 82 a plurality of times in a predetermined second measurement time zone after a predetermined time elapses from rising of the zero cross signal S1 (time zone estimated to include the time point of the peak value). Further, when the low level appears at least one time in the output of the second comparator 82, the second up/down counter 92 detects and determines that the absolute value of the peak voltage of the AC voltage has become the upper limit value or higher in the half period and increments the count value by one. On the contrary, when the low level has not ever appeared in the output of the second comparator 82, the second up/down counter 92 detects and determines that the absolute value of the peak voltage of the AC voltage has not become the upper limit value or higher in the half period and decrements the count value by one.

In addition, the second up/down counter 92 of the deviation determination circuit 90 may use the zero cross signal S1 as a trigger so as to check the output of the second comparator 82 one time at a second estimated time point when a predetermined time elapses after the zero cross signal S1 rises (time point estimated as the time point of the peak value). Further, when the output of the second comparator 82 of the second estimated time point is the low level, the second up/down counter 92 may detect and determine that the absolute value of the peak voltage of the AC voltage has become the upper limit value or higher in the half period so as to increment the count value by one. On the contrary, when the low level has not ever appeared in the output of the second comparator 82, the second up/down counter 92 detects and determines that the absolute value of the peak voltage of the AC voltage has not become the upper limit value or higher in the half period and decrements the count value by one.

Alternatively, the second up/down counter 92 may check the output of the second comparator 82 a plurality of times in a periodical and consecutive manner during a period from rising of the zero cross signal S1 to the next rising. In this case, when the low level appears in the output of the second comparator 82 during a period from rising of the zero cross signal S1 to the next rising (during the half period), the second up/down counter 92 detects and determines that the absolute value of the peak voltage of the AC voltage has become the upper limit value or higher in the half period and increments the count value by one. On the contrary, when the output of the second comparator 82 is maintained at high level during the half period, the second up/down counter 92 detects and determines that the absolute value of the peak voltage of the AC voltage has not become the upper limit value or higher in the half period and decrements the count value by one.

(Occurrence of to-be-Recorded Deviation and Determination of Convergence as to Lower Limit Value)

Figure 7:
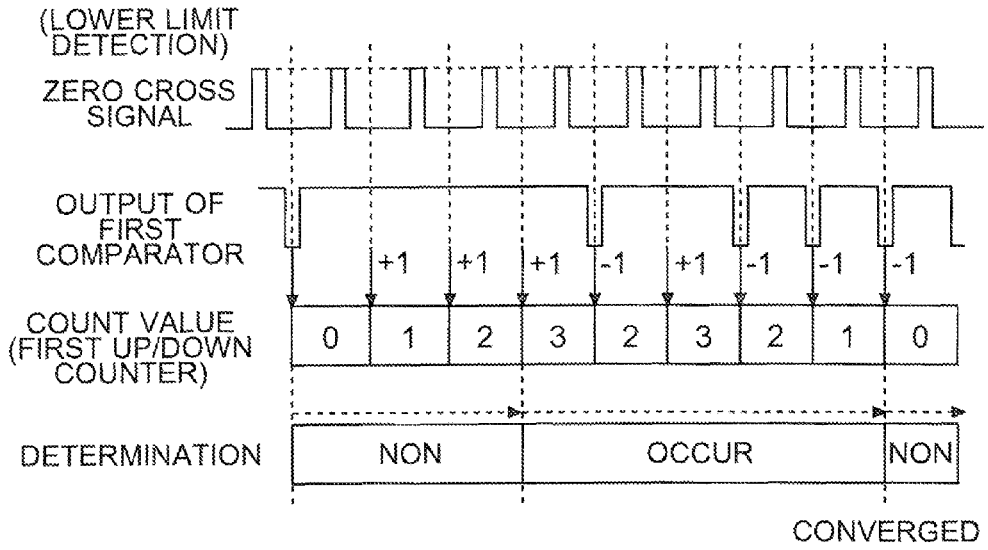
FIG. 7 shows an example of occurrence of a to-be-recorded deviation and determination of convergence with respect to a lower limit value.

Next, with reference to FIG. 7, occurrence of the to-be-recorded deviation and determination of convergence as to the lower limit value are described.

In the state where the AC voltage of the commercial power supply P is the lower limit value or lower, the first comparator 72 continues to output high level. Further, as shown in FIG. 7, the first up/down counter 91 increments or decrements the count value in accordance with whether or not the absolute value of the peak value of the AC voltage of the commercial power supply P is the lower limit value or lower in the half period. The minimum value thereof is zero. Further, the CPU 5 monitors the value of the first up/down counter 91 and determines that the to-be-recorded deviation, i.e., the AC voltage deviation for which information is recorded has occurred when the value of the first up/down counter 91 becomes a predetermined lower limit reference value or higher.

Here, the lower limit reference value can be appropriately determined. In the example of FIG. 7, the lower limit reference value is set to three. In order not to erroneously determine that an impulsive noise is the to-be-recorded deviation, it is preferred that the lower limit reference value be two or larger.

Further, when the value of the first up/down counter 91 becomes a predetermined lower limit convergence value after becoming the lower limit reference value or higher, the CPU 5 determines that the to-be-recorded deviation is converged. When the state of being the lower limit value or lower and the state of being higher than the lower limit value are alternately repeated every half period, the CPU 5 does not determine that the to-be-recorded deviation is converged. In the example of FIG. 7, the lower limit convergence value is set to zero. The lower limit convergence value can be appropriately set. However, the lower limit convergence value is set to a value larger than or equal to zero and lower than the limit reference value.

Here, the CPU 5 includes a timer unit 51 for keeping time and date (see FIGS. 2 and 4). Alternatively, the timer unit 51 may not be included in the CPU 5 but may be separately mounted on a circuit board of the control unit 4. Further, the timer unit 51 measures a lower limit keeping period until the value of the first up/down counter 91 becomes the lower limit convergence value after becoming the lower limit reference value or higher. By storing the lower limit keeping period in the storage unit 40, it is possible to save data indicating a time point when the state of a large deviation from the nominal voltage of the commercial power supply P has occurred and a length while the state lasts.

(Occurrence of to-be-Recorded Deviation and Determination of Convergence as to Upper Limit Value)

Figure 8:
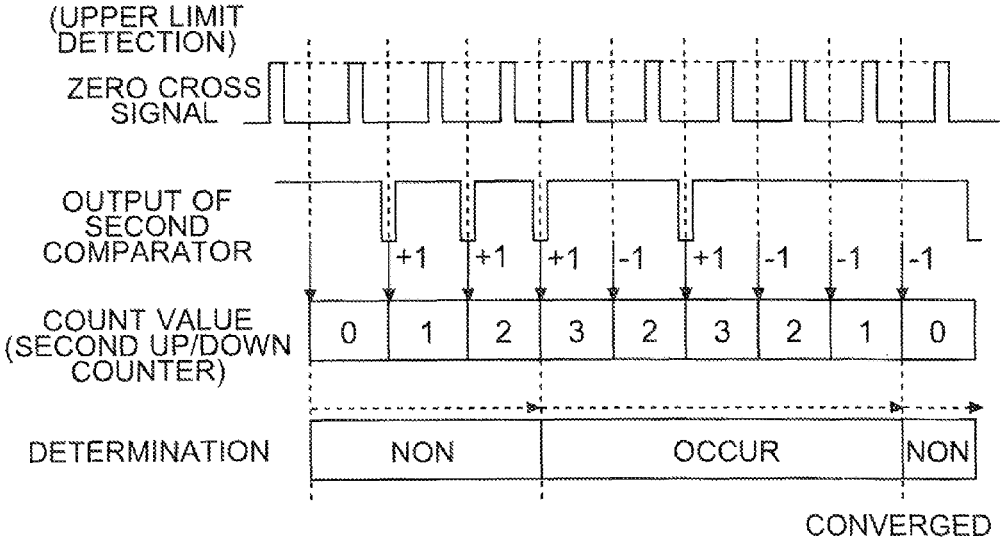
FIG. 8 shows an example of occurrence of a to-be-recorded deviation and determination of convergence with respect to an upper limit value.

Next, with reference to FIG. 8, occurrence of the to-be-recorded deviation and determination of convergence as to the upper limit value are described.

In the state where the AC voltage of the commercial power supply P is the upper limit value or higher, the second comparator 82 outputs the low level. Further, as shown in FIG. 8, the second up/down counter 92 increments or decrements the count value in accordance with whether or not the absolute value of the peak value of the AC voltage of the commercial power supply P becomes the upper limit value or higher in the half period. The minimum value thereof is zero. Further, the CPU 5 monitors the value of the second up/down counter 92 and determines that the to-be-recorded deviation, i.e., the AC voltage deviation for which information is recorded has occurred when the value of the second up/down counter 92 becomes a predetermined upper limit reference value or higher.

Here, the upper limit reference value can be appropriately determined. Also in the example of FIG. 8, the upper limit reference value is set to three (similarly to the lower limit reference value). In order not to erroneously determine that an impulsive noise is the to-be-recorded deviation, it is preferred that the upper limit reference value be also two or larger.

Further, when the value of the second up/down counter 92 becomes a predetermined upper limit convergence value after becoming the upper limit reference value or higher, the CPU 5 determines that the to-be-recorded deviation is converged. When the state of being the upper limit value or higher and the state of being lower than the upper limit value are alternately repeated every half period, the CPU 5 does not determine that the to-be-recorded deviation is converged. In the example of FIG. 8, the upper limit convergence value is set to zero. The upper limit convergence value can be appropriately set. However, the upper limit convergence value is also set to a value larger than or equal to zero and lower than the upper limit reference value.

The timer unit 51 measures an upper limit keeping period until the value of the second up/down counter 92 becomes the upper limit reference value or higher after becoming the upper limit convergence value. By storing the upper limit keeping period in the storage unit 40, it is possible to save data indicating a time point when the state of a large deviation from the nominal voltage of the commercial power supply P has occurred and a length while the state lasts.

In this way, in the multifunction peripheral 100 of this embodiment, the control unit 4 (CPU 5) checks whether or not the absolute value of the peak value of the AC voltage of the commercial power supply P has become the predetermined upper limit value or higher and whether or not the absolute value has become the predetermined lower limit value or lower, so as to measure the period while the state of a large voltage deviation from the nominal voltage lasts.

(Deviation Information i1)

Figure 9:
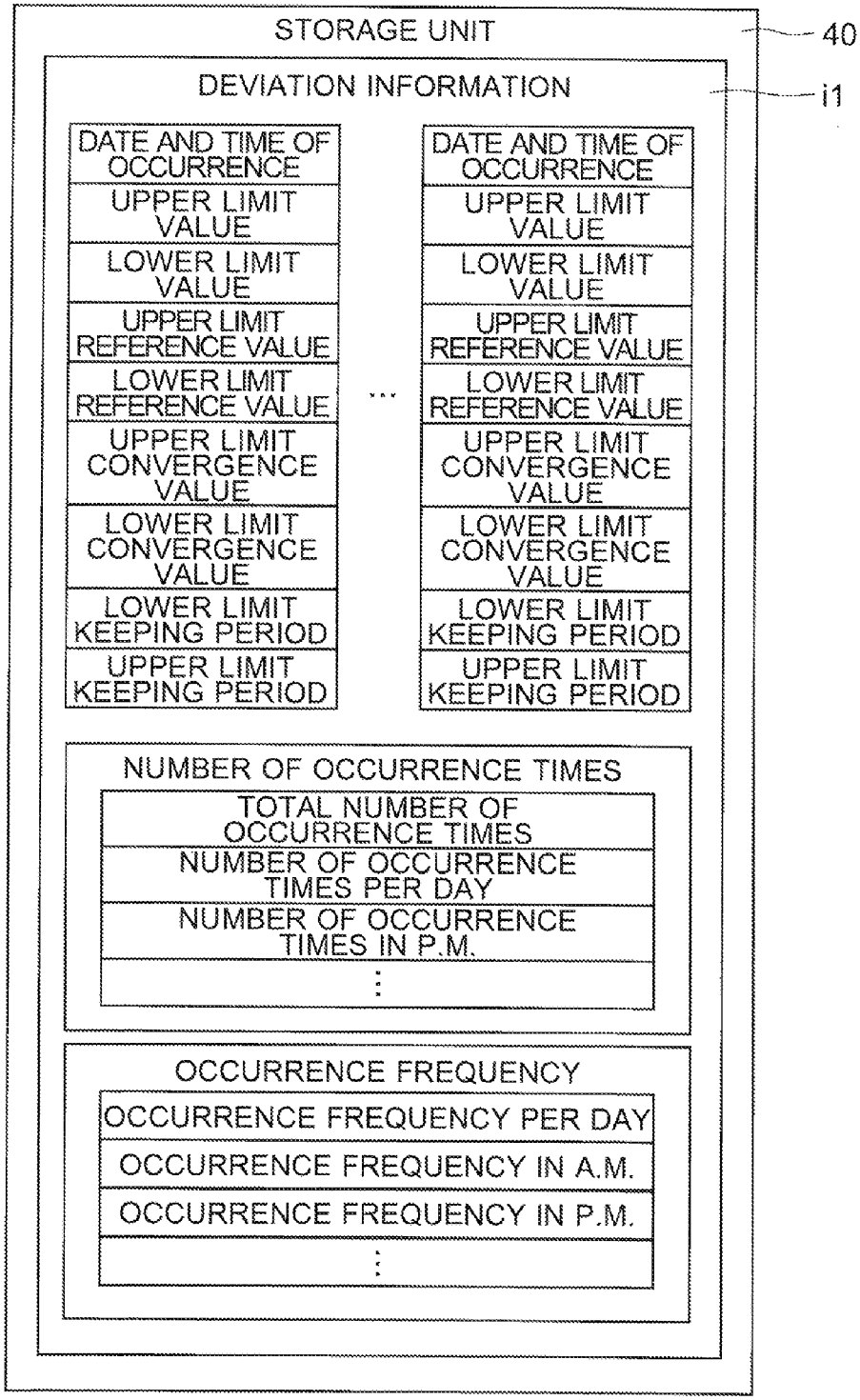
FIG. 9 shows an example of deviation information stored in the storage unit.

Next, with reference to FIG. 9, there is described the deviation information i1 to be stored (recorded) in the storage unit 40 when it is determined that the to-be-recorded deviation has occurred.

When the control unit 4 (CPU 5) recognizes occurrence of the to-be-recorded deviation, the storage unit 40 stores the deviation information i1 related to the generated to-be-recorded deviation in a nonvolatile manner. The CPU 5 controls so that the deviation information i1 includes date and time when the to-be-recorded deviation has occurred, various set values (the upper limit value, the lower limit value, the upper limit reference value, the lower limit reference value, the upper limit convergence value, and the lower limit convergence value) when it is determined that the to-be-recorded deviation has occurred, the lower limit keeping period, the upper limit keeping period, the number of occurrence times, and the occurrence frequency. The CPU 5 according to the embodiment controls the storage unit 40 to store all these items. It is possible to control the storage unit 40 to store one or more of these items as the deviation information i1.

Specifically, the CPU 5 controls the storage unit 40 to store the date and time of occurrence, the various set values (the upper limit value, the lower limit value, the upper limit reference value, the lower limit reference value, the upper limit convergence value, and the lower limit convergence value), the lower limit keeping period, and the upper limit keeping period every time when determining that the to-be-recorded deviation has occurred (see FIG. 9). These are data specifically indicating a large voltage deviation in each time.

In addition, the CPU 5 controls so that the deviation information i1 stored in the storage unit 40 includes information about the number of occurrence times of the to-be-recorded deviation. As shown in FIG. 9, the CPU 5 may control the storage unit 40 to store the total number of occurrence times of the to-be-recorded deviation determined to have occurred from installation of the multifunction peripheral 100 to the present or an average number of occurrence times per day. In addition, the CPU 5 may calculates the number of occurrence times every time zone such as a.m. and p.m. on the basis of the date and time of the occurrence of each to-be-recorded deviation stored as the deviation information i1, so as to control the storage unit 40 to store the number of occurrence times in each time zone. Note that a.m. and p.m. are exemplified as the time zones. However, the time zones may be early morning (e.g., 4 to 8 o'clock), morning (e.g., 8 to 12 o'clock), noon (e.g., 12 to 16 o'clock), evening (e.g., 16 to 20 o'clock), night (e.g., 20 to 24 o'clock), and midnight (0 to 4 o'clock). Alternatively, time zones may be one-hour periods.

In addition, the CPU 5 controls so that the deviation information i1 stored in the storage unit 40 includes information about occurrence frequency of the to-be-recorded deviation. As shown in FIG. 9, the CPU 5 determines the occurrence frequency in each of the predetermined time zones such as per day, a.m. and p.m. on the basis of the occurrence date and time of each to-be-recorded deviation stored as each deviation information i1. Then, the CPU 5 controls the storage unit 40 to store the determined occurrence frequency. Although a day, a.m., and p.m. are exemplified, it is possible to determine appropriately time zones similarly to the case of the number of occurrence times. In addition, it is possible to distinguish between the case of becoming the upper limit value or higher and the case of becoming the lower limit value or lower, and to control to record the number of occurrence times of the to-be-recorded deviation or the occurrence frequency of the to-be-recorded deviation in accordance with the case.

(Setting of Various Set Values)

Figure 10:
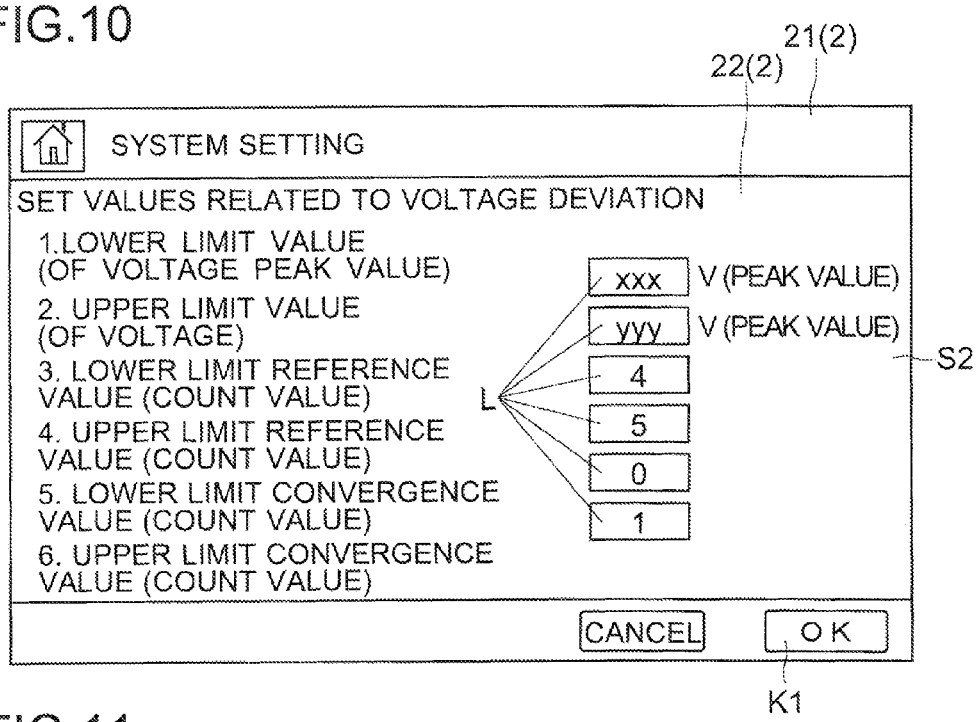
FIG. 10 shows an example of a setting screen for various set values related to the to-be-recorded deviation.

Next, with reference to FIG. 10, setting of the various set values related to the to-be-recorded deviation is described.

A setting screen S2 for setting a set value related to the to-be-recorded deviation can be displayed by operating a key displayed on the operation panel 2 or by operating the hardware key 23 disposed on the operation panel 2. In other words, the display unit 21 displays the setting screen S2 when a predetermined operation is made with the operation panel 2.

By making an operation with the setting screen S2, the lower limit value, the upper limit value, the lower limit reference value, the upper limit reference value, the lower limit convergence value, and the upper limit convergence value can be set. The user touches a display position of a setting box L of an item of a set value to be set. When the touch panel unit 22 accepts the operation to the position of the setting box L, the display unit 21 displays a software keyboard (not shown) for setting a value. Then, the touch panel unit 22 accepts the input of setting the set value with the software keyboard. Then, the display unit 21 displays the input result in the setting box L of the touch operation. Note that default values are set for the various set values (the lower limit value, the upper limit value, the lower limit reference value, the upper limit reference value, the lower limit convergence value, and the upper limit convergence value). Without setting on the setting screen S2, the default value is used. Thus, the lower limit value and the upper limit value can be set in consideration of the AC voltage of the commercial power supply P in a country or a region where the image forming apparatus is sold and used, the withstand voltage of the power supply device 6, the voltage necessary for driving the circuits of the image forming apparatus, and the like.

Further, when the touch panel unit 22 recognizes the operation to an OK key on the setting screen, the CPU 5 updates the set value with the newly set value of the item for which the set value is changed. In other words, the CPU 5 controls the storage unit 40 to store the set value set on the setting screen S2 as set value information i2 (see FIG. 4) in a nonvolatile manner. The CPU 51 determines whether or not the to-be-recorded deviation has occurred and whether or not the to-be-recorded deviation is converged on the basis of the lower limit value, the upper limit value, the lower limit reference value, the upper limit reference value, the lower limit convergence value, and the upper limit convergence value defined by the set value information i2 stored in the storage unit 40.

Specifically, when the lower limit value is changed, the CPU 5 issues an instruction to the first reference voltage generator 71 to generate the first reference voltage Vref1 corresponding to the lower limit value after changing. The CPU 5 issues an instruction to the first reference voltage generator 71 to generate a voltage having the same value as the voltage V1 when the absolute value of the AC voltage (output of the diode bridge circuit 63) is the lower limit value as the first reference voltage Vref1 (see FIG. 4). The first reference voltage generator 71 outputs an analog voltage having the instructed value. In addition, when the upper limit value is changed, the CPU 5 issues an instruction to the second reference voltage generator 81 to generate the second reference voltage Vref2 corresponding to the upper limit value after changing. The CPU 5 issues an instruction to the second reference voltage generator 81 to generate a voltage having the same value as the voltage V2 when the absolute value of the AC voltage (output of the diode bridge circuit 63) is the upper limit value as the second reference voltage Vref2 (see FIG. 4). The second reference voltage generator 81 outputs an analog voltage having the instructed value.

In addition, when the lower limit reference value is changed, the CPU 5 determines that the to-be-recorded deviation has occurred when the value of the first up/down counter 91 becomes the lower limit reference value after changing. In addition, when the upper limit reference value is changed, the CPU 5 determines that the to-be-recorded deviation has occurred when the value of the second up/down counter 92 becomes the upper limit reference value after changing. In addition, when the lower limit convergence value is changed, the CPU 5 determines that the to-be-recorded deviation is converged (finished) when the value of the first up/down counter 91 becomes a new lower limit convergence value after determining that the to-be-recorded deviation has occurred. In addition, when the upper limit convergence value is changed, the CPU 5 determines that the to-be-recorded deviation is converged (finished) when the value of the second up/down counter 92 becomes a new upper limit convergence value after determining that the to-be-recorded deviation has occurred.

(Flow of Process Related to to-be-Recorded Deviation)

Figure 11:
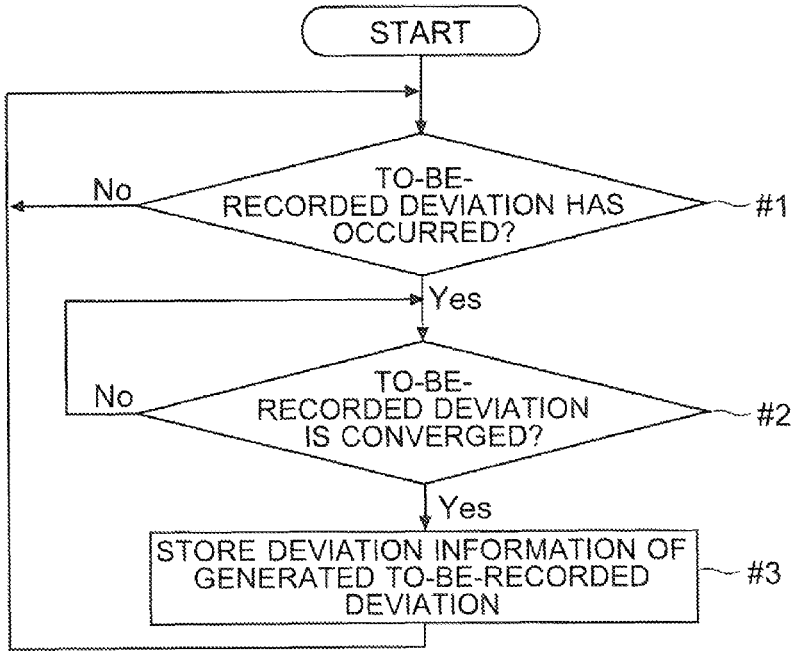
FIG. 11 is a flowchart showing an example of a flow of processing the to-be-recorded deviation.

Next, with reference to FIG. 11, an example of the flow related to the to-be-recorded deviation is described.

The flow of FIG. 11 starts at a time point when the main power of the multifunction peripheral 100 is turned on so that the determining unit 9 is activated. Alternatively, it starts at a start time point of determining whether or not the to-be-recorded deviation has occurred in the case where the determining time is set in advance. The CPU 5 continues to determine whether or not the to-be-recorded deviation has occurred by using the set (or default in the case without setting) lower limit value, lower limit reference value, upper limit value, upper limit reference value, and zero cross signal S1 (Step #1, No in Step #1 to Step #1). When the to-be-recorded deviation has occurred, the CPU 5 continues to check whether or not the to-be-recorded deviation is converged (Step #2, No in Step #2 to Step #2).

When the to-be-recorded deviation is converged (Yes in Step #2), the CPU 5 controls the storage unit 40 to store (record) the deviation information i1 containing the date and time of occurrence, the various set values (the upper limit value, the lower limit value, the upper limit reference value, the lower limit reference value, the upper limit convergence value, and the lower limit convergence value), the lower limit keeping period, the upper limit keeping period, the number of occurrence times, and the occurrence frequency as for the generated to-be-recorded deviation (Step #3). After Step #3, the flow returns to Step #1. In this way, it is possible to continuously perform the process of FIG. 11 in the state where the main power of the multifunction peripheral 100 is on. In addition, it is possible not to perform the process of FIG. 11 when the multifunction peripheral 100 transfers to a power save mode.

(Output of Deviation Information i1)

Figure 12:
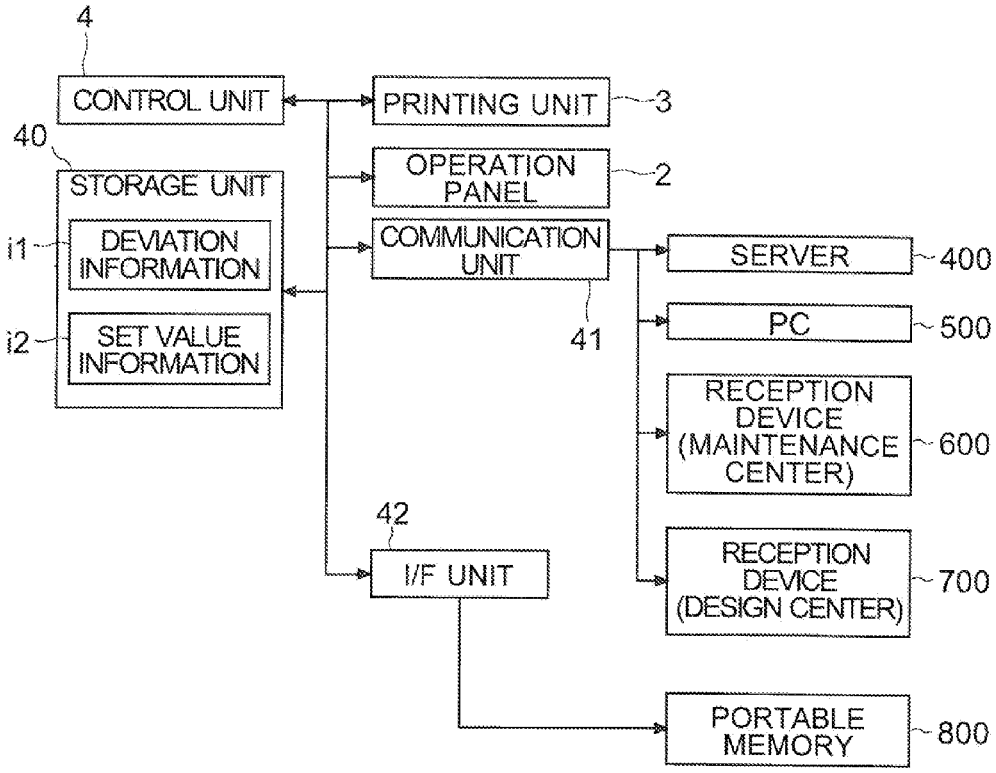
FIG. 12 shows an example of an output configuration of the deviation information.

Next, with respect to FIG. 12, an output of the deviation information i1 is described.

The multifunction peripheral 100 can output the deviation information i1 stored in the storage unit 40. The deviation information i1 can be output in a form of printing, displaying on the display unit 21, transmitting via the communication unit 41, or writing in a portable memory 800 connected to the multifunction peripheral 100. For this reason, the printing unit 3, the operation panel 2, the communication unit 41, and an I/F unit 42 in the multifunction peripheral 100 work as an output unit. Further, the touch panel unit 22 of the operation panel 2 accepts an input of determining an output form of the deviation information i1.

When an instruction to print the deviation information i1 is issued, the control unit 4 controls the printing unit 3 to print the deviation information i1. Alternatively, when an instruction to display the deviation information i1 on the display unit 21 is issued, the control unit 4 controls the display unit 21 of the operation panel 2 to display the deviation information i1. Thus, the deviation information i1 can be viewed and recognized with the multifunction peripheral 100.

In addition, when an instruction to transmit the deviation information i1 is issued, the control unit 4 controls the communication unit 41 to transmit the deviation information i1. As shown in FIG. 12, as a destination of the transmission, it is possible to select a server 400 (data server) for storing maintenance data, an administrator's PC 500, a reception device 600 installed in a maintenance company (maintenance center) for the multifunction peripheral 100, a reception device 700 installed in a design center in charge of developing the image forming apparatus, or the like. The touch panel unit 22 accepts an input of setting the destination of the deviation information i1. Then, the control unit 4 controls the communication unit 41 to transmit the deviation information i1 to the set destination.

In addition, the multifunction peripheral 100 of this embodiment includes the I/F unit 42 for connecting the portable memory 800 such as a semiconductor memory (a USB memory or any type of memory card) or an external HDD. The I/F unit 42 includes a socket to which a terminal of the portable memory 800 is inserted and a communication circuit for controlling communication between the control unit 4 and the connected portable memory 800. Further, when an instruction to write the deviation information i1 to the portable memory 800 is issued in the state where the portable memory 800 is connected to the I/F unit 42, the control unit 4 controls the I/F unit 42 to write the deviation information i1. Thus, a maintenance person who performs the maintenance can pick up the deviation information i1.

In this way, the image forming apparatus (multifunction peripheral 100) according to the embodiment includes the zero cross signal generator 64 for generating the zero cross signal S1 on the basis of the AC voltage input to the image forming apparatus, the lower limit detector 7 for detecting whether or not the absolute value of the peak voltage of the AC voltage input to the image forming apparatus is the predetermined lower limit value or lower, the first up/down counter 91, the determining unit 9 (the CPU 5 and the deviation determination circuit 90) that checks whether or not the absolute value of the peak voltage is the lower limit value or lower on the basis of the zero cross signal S1 and the output of the lower limit detector 7 every half period of the AC voltage, controls the first up/down counter 91 to increment by one when the absolute value of the peak voltage of the AC voltage in half period is the lower limit value or lower, controls the first up/down counter 91 to decrement by one when the absolute value has not become the lower limit value or lower, determines that the to-be-recorded deviation as the AC voltage deviation for which information is recorded has occurred when the value of the first up/down counter 91 becomes the predetermined lower limit reference value or higher, and the storage unit 40 for storing the deviation information i1 indicating contents of the voltage deviation of the to-be-recorded deviation in a nonvolatile manner when the determining unit 9 determines that the to-be-recorded deviation has occurred.

In this way, when the voltage deviation has occurred in which the peak absolute value (maximum value) of the AC voltage of the commercial power supply P is lower than the lower limit value, or when the voltage deviation has repeatedly occurred, the deviation information i1 is stored. In other words, the information is recorded, which indicates the situation of the commercial power supply P of a country or a region where the image forming apparatus (multifunction peripheral 100) is used and is related to an abnormal deviation of the commercial power supply P (from the nominal voltage or the reference voltage). By checking and analyzing the deviation information i1, it is possible to utilize the deviation information i1 for developing and designing the power supply device 6, which does not cause a breakdown or a malfunction of the image forming apparatus even if the abnormal deviation occurs in the commercial power supply P in a country or a region where the image forming apparatus is used. Further, even if the absolute value of the peak voltage of the AC voltage becomes the lower limit value or lower abruptly because of an impulsive noise, it is possible not to record the deviation information i1 by the first up/down counter 91 and the lower limit reference value.

In addition, the image forming apparatus (multifunction peripheral 100) according to the embodiment includes the upper limit detector 8 for detecting that the absolute value of the AC voltage input to the image forming apparatus becomes the predetermined upper limit value or higher. The determining unit 9 (the CPU 5 and the deviation determination circuit 90) includes the second up/down counter 92, checks whether or not the absolute value of the AC voltage has become the upper limit value or higher on the basis of the zero cross signal S1 and the output of the upper limit detector 8 every half period of the AC voltage, controls the second up/down counter 92 to increment by one when the absolute value of the AC voltage has become the upper limit value or higher in the half period of the AC voltage, controls the second up/down counter 92 to decrement by one when the absolute value has not become the upper limit value or higher, and determines that the to-be-recorded deviation has occurred when the value of the second up/down counter 92 becomes the predetermined upper limit reference value or higher.

In this way, the deviation information i1 is stored when the voltage deviation has occurred so that the absolute value of the peak voltage (maximum value) of the AC voltage of the commercial power supply P has exceeded the upper limit value, or when the voltage deviation has repeatedly occurred. In other words, the information is recorded, which indicates the situation of the commercial power supply P of a country or a region where the image forming apparatus (multifunction peripheral 100) is used and is related to an abnormal deviation of the commercial power supply P (from the nominal voltage or the reference voltage). Then, by checking and analyzing the deviation information i1, it is possible to utilize the deviation information i1 for developing and designing the power supply device 6, which does not cause a breakdown or a malfunction of the image forming apparatus even if the abnormal deviation occurs in the commercial power supply P in a country or a region where the image forming apparatus is used. Further, even if the absolute value of the peak voltage of the AC voltage becomes the upper limit value or higher abruptly because of an impulsive noise, it is possible not to record the deviation information i1 by the second up/down counter 92.

In addition, when the value of the first up/down counter 91 becomes the predetermined lower limit convergence value after becoming the lower limit reference value or higher, the determining unit 9 (the CPU 5 and the deviation determination circuit 90) determines that the to-be-recorded deviation is converged. When the value of the second up/down counter 92 becomes the predetermined upper limit convergence value after becoming the upper limit reference value or higher, the determining unit 9 determines that the to-be-recorded deviation is converged. In this way, it is possible to obtain the period of time from the start to the convergence of the abnormal deviation of the commercial power supply voltage.

In addition, the image forming apparatus (multifunction peripheral 100) according to the embodiment includes the timer unit 51 for keeping time and measuring date and time. Further, the storage unit 40 stores one or more of date and time when the to-be-recorded deviation has occurred, the upper limit value, the lower limit value, the upper limit reference value, the lower limit reference value, the upper limit convergence value, the lower limit convergence value, the lower limit keeping period until the value of the first up/down counter 91 becomes lower limit convergence value after becoming the lower limit reference value or higher, the upper limit keeping period until the value of the second up/down counter 92 becomes the upper limit convergence value after becoming the upper limit reference value or higher, and the number of occurrence times of the to-be-recorded deviation, and the occurrence frequency of the to-be-recorded deviation, as the deviation information i1.

In this way, the information is stored, which is useful for knowing the situation of the commercial power supply P of a country or a region where the image forming apparatus (multifunction peripheral 100) is used, such as a condition value used for determining presence or absence of the abnormal voltage deviation, a period of time while the abnormal deviation of the AC voltage lasts, the number of times thereof, the date and time thereof, and the like. Further, by checking and analyzing the values of these items, it is possible to develop and design the power supply device 6, which does not cause a breakdown of the power supply device 6 or a malfunction of the image forming apparatus (multifunction peripheral 100) even if the AC voltage deviation of the commercial power supply P (peak value deviation) occurs.

In addition, the image forming apparatus (multifunction peripheral 100) according to the embodiment includes the operation unit (the operation panel 2, the display unit 21, and the touch panel unit 22) for accepting the input for setting one or more of the upper limit value, the lower limit value, the upper limit reference value, the lower limit reference value, the upper limit convergence value, and the lower limit convergence value. The determining unit 9 (the CPU 5 and the deviation determination circuit 90) performs the determination by using the value set with the operation unit. In this way, it is possible to arbitrarily set a value for determining whether or not the to-be-recorded abnormal deviation has occurred. Accordingly, it is possible to set the appropriate value for determining whether or not the to-be-recorded deviation has occurred and whether or not the to-be-recorded deviation is converged by considering the specification of the power supply device 6 of the image forming apparatus (multifunction peripheral 100) and the nominal voltage of the commercial power supply P.

In addition, the image forming apparatus (multifunction peripheral 100) according to the embodiment includes the output unit (the printing unit 3, the operation panel 2, the communication unit 41, and the I/F unit 42) for outputting the deviation information i1 stored in the storage unit 40. In this way, it is possible to output the deviation information i1 via the output unit so as to check the deviation information i1.

In addition, the image forming apparatus (multifunction peripheral 100) according to the embodiment includes the rectifying circuit (diode bridge circuit 63) for rectifying the AC voltage input to the image forming apparatus. The lower limit detector 7 detects whether or not the absolute value of the peak voltage of the AC voltage input to the image forming apparatus is the lower limit value or lower on the basis of the DC voltage obtained by rectifying with the rectifying circuit. The upper limit detector 8 detects whether or not the AC voltage input to the image forming apparatus is the upper limit value or higher on the basis of the DC voltage obtained by rectifying with the rectifying circuit. In this way, it is not necessary to prepare the lower limit detector 7 and the upper limit detector 8 respectively for a positive value of the AC voltage and for a negative value of the AC voltage.

In addition, the zero cross signal generator 64 outputs high level when the absolute value of the AC voltage of the commercial power supply P is within a certain range including zero and outputs low level when the absolute value is larger than the certain range. The lower limit detector 7 outputs high level in a period while the absolute value of the AC voltage of the commercial power supply P is the lower limit value or lower. The determining unit 9 determines whether or not the absolute value of the peak voltage of the AC voltage in the half period is the lower limit value or lower on the basis of whether the waveform of the output of the lower limit detector 7 is high level or low level during a period from rising of the zero cross signal S1 to the next rising. In addition, the upper limit detector 8 outputs low level in the period while the absolute value of the AC voltage of the commercial power supply P is the upper limit value or higher. The determining unit 9 determines whether or not the absolute value of the peak voltage of the AC voltage is the upper limit value or higher in the half period on the basis of whether the output value of the upper limit detector 8 is high level or low level during a period from rising of the zero cross signal S1 to the next rising. In this way, it is possible to correctly and easily detect the abnormal deviation of the commercial power supply P.

Although the embodiment of the present disclosure is described above, the scope of the present disclosure is not limited to the embodiment but can be modified variously without deviating from the spirit of the disclosure.

What is claimed is:

1. An image forming apparatus comprising:

a zero cross signal generator configured to generate a zero cross signal on the basis of an AC voltage input to the image forming apparatus;

a lower limit detector for detecting whether or not an absolute value of a peak voltage of the AC voltage input to the image forming apparatus is a predetermined lower limit value or lower;

a determining unit including a first up/down counter, the determining unit configured to check whether or not the absolute value of the peak voltage is the lower limit value or lower every half period of the AC voltage on the basis of the zero cross signal and an output of the lower limit detector, to control the first up/down counter to increment by one when the absolute value is the lower limit value or lower, to control the first up/down counter to decrement by one when the absolute value is higher than the lower limit value, and to determine that a to-be-recorded deviation as a deviation of the AC voltage to be recorded has occurred when a value of the first up/down counter becomes a predetermined lower limit reference value or higher; and a storage unit for storing deviation information indicating a voltage deviation of the to-be-recorded deviation in a nonvolatile manner when the determining unit determines that the to-be-recorded deviation has occurred.

2. The image forming apparatus according to claim 1, further comprising an upper limit detector for detecting that an absolute value of the AC voltage input to the image forming apparatus has become a predetermined upper limit value or higher, wherein the determining unit includes a second up/down counter, checks whether or not the absolute value has become the upper limit value or higher every half period of the AC voltage on the basis of the zero cross signal and the output of the upper limit detector, controls the second up/down counter to increment by one when the absolute value has become the upper limit value or higher, controls the second up/down counter to decrement by one when the absolute value has not become the upper limit value or higher, and determines that the to-be-recorded deviation has occurred when a value of the second up/down counter becomes a predetermined upper limit reference value or higher.

3. The image forming apparatus according to claim 2, wherein the determining unit determines that the to-be-recorded deviation is converged when the value of the first up/down counter becomes a predetermined lower limit convergence value after being the lower limit reference value or higher, and determines that the to-be-recorded deviation is converged when the value of the second up/down counter becomes a predetermined upper limit convergence value after being the upper limit reference value or higher.

4. The image forming apparatus according to claim 3, further comprising a timer unit configured to keep time so as to measure date and time, wherein the storage unit stores one or more of date and time when the to-be-recorded deviation has occurred, the upper limit value, the lower limit value, the upper limit reference value, the lower limit reference value, the upper limit convergence value, the lower limit convergence value, a lower limit keeping period until the value of the first up/down counter becomes the lower limit convergence value after being the lower limit reference value or higher, an upper limit keeping period until the value of the second up/down counter becomes the upper limit convergence value after being the upper limit reference value or higher, the number of occurrence times of the to-be-recorded deviation, and an occurrence frequency of the to-be-recorded deviation, as the deviation information.

5. The image forming apparatus according to claim 3, further comprising an operation unit configured to accept an input for setting one or more of the upper limit value, the lower limit value, the upper limit reference value, the lower limit reference value, the upper limit convergence value, and the lower limit convergence value, wherein the determining unit performs the determination by using the value set with the operation unit.

6. The image forming apparatus according to claim 1, further comprising an output unit configured to output the deviation information stored in the storage unit.

7. The image forming apparatus according to claim 2, further comprising a rectifying circuit for rectifying the AC voltage input to the image forming apparatus, wherein the lower limit detector detects whether or not the absolute value of the peak voltage of the AC voltage input to the image forming apparatus is the lower limit value or lower on the basis of a DC voltage obtained by rectifying with the rectifying circuit, and the upper limit detector detects whether or not the AC voltage input to the image forming apparatus is the upper limit value or higher on the basis of the DC voltage obtained by rectifying with the rectifying circuit.

8. The image forming apparatus according to claim 1, wherein the zero cross signal generator outputs high level when the absolute value of the AC voltage of the commercial power supply is a voltage value within a certain range including zero and outputs low level when the absolute value is higher than the certain range, the lower limit detector outputs high level in a period while the absolute value of the AC voltage of the commercial power supply is the lower limit value or lower, and the determining unit determines whether or not the absolute value of the peak voltage of the AC voltage is the lower limit value or lower in the half period on the basis of whether an output waveform of the lower limit detector is high level or low level in a period from rising of the zero cross signal to the next rising.

9. The image forming apparatus according to claim 2, wherein the zero cross signal generator outputs high level when the absolute value of the AC voltage of the commercial power supply is a voltage value within a certain range including zero, and outputs low level when the absolute value is higher than the voltage value in the certain range, the upper limit detector outputs low level in a period while the absolute value of the AC voltage of the commercial power supply is the upper limit value or higher, and the determining unit determines whether or not the absolute value of the peak voltage of the AC voltage is the upper limit value or higher in the half period on the basis of whether the output value of the upper limit detector is high level or low level in a period from rising of the zero cross signal to the next rising.

10. A method for controlling an image forming apparatus, the method comprising the steps of:

generating a zero cross signal on the basis of an AC voltage input to the image forming apparatus;

detecting whether or not an absolute value of a peak voltage of the AC voltage input to the image forming apparatus is a predetermined lower limit value or lower;

checking whether or not the absolute value of the peak voltage is the lower limit value or lower every half period of the AC voltage on the basis of the zero cross signal and an output of the lower limit detector;

controlling a first up/down counter to increment by one when the absolute value is the lower limit value or lower;

controlling the first up/down counter to decrement by one when the absolute value is higher than the lower limit value;

determining that a to-be-recorded deviation as a deviation of the AC voltage to be recorded has occurred when a value of the first up/down counter becomes a predetermined lower limit reference value or higher; and storing deviation information indicating a voltage deviation of the to-be-recorded deviation in a nonvolatile manner when the determining unit determines that the to-be-recorded deviation has occurred.

* * * * *